US011332909B2

(12) United States Patent
Takeuchi et al.

(10) Patent No.: US 11,332,909 B2
(45) Date of Patent: May 17, 2022

(54) WORKING VEHICLE

(71) Applicant: TAKEUCHI MFG. CO., LTD., Nagano (JP)

(72) Inventors: Shingo Takeuchi, Nagano (JP); Yuta Nakamura, Nagano (JP)

(73) Assignee: TAKEUCHI MFG. CO., LTD., Nagano (JP)

( * ) Notice: Subject to any disclaimer, the term of this patent is extended or adjusted under 35 U.S.C. 154(b) by 426 days.

(21) Appl. No.: 16/584,300

(22) Filed: Sep. 26, 2019

(65) Prior Publication Data

US 2020/0407942 A1 Dec. 31, 2020

(30) Foreign Application Priority Data

Jun. 28, 2019 (JP) ..... JP2019-121113

(51) Int. Cl.

| | |
|---|---|
| ***E02F 9/00*** | (2006.01) |
| ***B66C 1/20*** | (2006.01) |
| ***B66C 1/34*** | (2006.01) |

(52) U.S. Cl.

CPC ..... *E02F 9/003* (2013.01); *B66C 1/20* (2013.01); *B66C 1/34* (2013.01); *Y10S 294/904* (2013.01)

(58) Field of Classification Search

CPC ... B66C 1/20; B66C 1/34; E02F 9/003; Y10S 294/904; B60P 3/062

USPC ..... 294/82.11, 904

See application file for complete search history.

(56) References Cited

U.S. PATENT DOCUMENTS 1,270,571 A * 6/1918 Victel et al. ..... B66C 1/34 294/904
4,153,262 A * 5/1979 Diamond ..... B66F 9/07545 280/756
8,714,592 B1 * 5/2014 Thoreson ..... B60D 1/488 280/769

(Continued)

FOREIGN PATENT DOCUMENTS

| | | | |
|---|---|---|---|
| DE | 1198031 | * | 8/1965 |
| JP | U4-70355 | | 6/1992 |
| JP | 2002371592 | | 12/2002 |

(Continued)

OTHER PUBLICATIONS

Japanese Office Action dated Feb. 8, 2022 in Japanese Application No. 2019-121113.

*Primary Examiner* — Dean J Kramer
(74) *Attorney, Agent, or Firm* — Stephen J. Weyer, Esq.; Stites & Harbison, PLLC

(57) ABSTRACT

There is provided a working vehicle capable of simplifying a structure and reducing manufacturing costs by realizing a configuration in which a tying-down attachment point doubles as a lifting attachment point. A working vehicle according to the present invention includes tying-down attachment points for locking a tightening member for preventing reversal at the time of transportation or parking in at least the front of a vehicle body, in which the tying-down attachment points are arranged at right-and-left two places on a front end surface of the vehicle body, capable of locking a lifting member for lifting the vehicle body upward and having strength in a vertical direction enough to withstand a load applied at the time of lifting the vehicle body upward after locking the lifting member, thereby doubling as lifting attachment points.

4 Claims, 7 Drawing Sheets

(56) References Cited

U.S. PATENT DOCUMENTS

| | | | | |
|---|---|---|---|---|
| 9,016,741 | B1 * | 4/2015 | Thoreson | B66C 1/20<br>294/67.1 |
| 2017/0240388 | A1 * | 8/2017 | Heinzmann | B66C 1/66 |

FOREIGN PATENT DOCUMENTS

| | | |
|---|---|---|
| JP | 2007-231645 | 9/2007 |
| JP | 2009-203682 | 9/2009 |

* cited by examiner

WORKING VEHICLE

CROSS-REFERENCE TO RELATED APPLICATION

This application is based upon and claims the benefit of priority of the prior Japanese Patent Application No. P2019-121113, filed on Jun. 28, 2019, and the entire contents of which are incorporated herein by reference.

TECHNICAL FIELD

The present invention relates to a working vehicle, and more particularly relates to a working vehicle including tying-down attachment points for locking a tightening member for preventing reversal at the time of transportation or parking.

BACKGROUND ART

There is a working vehicle, as an example, including travel units having a right and left pair of crawlers, a vehicle body provided on the travel units and a work unit provided in a front part of the vehicle body. Specifically, a crawler-type skid steer loader provided with a loader unit as the work unit, a power shovel (excavator) provided with a shovel unit as the work unit and so on are known.

In a process of transporting such working vehicle to a work site, for example, there are cases where the working vehicle is lifted by a crane or the like and placed on a deck of a transportation vehicle or the like, where the working vehicle is moved upward or downward to work sites at a high place and a low place and so on. Accordingly, a lifting mechanism (referred to as a "lifting attachment point" in the present application) for lifting the working vehicle has been developed (refer to PTL 1: JP-A-2002-371592).

In the case where the working vehicle is placed on the deck of the transportation vehicle or the like and transported, a tying-down mechanism (referred to as a "tying-down attachment point" in the present application) for locking the tightening member for preventing reversal during transportation has been also developed (refer to PTL 2: JP-UM-A-4-70355)

CITATION LIST

Patent Literature

PTL 1: JP-A-2002-371592
PTL 2: JP-UM-A-4-70355

SUMMARY OF INVENTION

Technical Problem

However, the lifting attachment point and the tying-down attachment point have been generally designed and manufactured independently as different exclusive goods in related-art working vehicles. Accordingly, when the lifting attachment point and the tying-down attachment point are arranged in the vehicle body, there is a problem that dedicated spaces and support portions are necessary for respective points, which complicates the structure. There is also a problem that the number of components is increased and man-hour for installation is increased, which incurs the increase in manufacturing costs.

Solution to Problem

In response to the above issue, one or more aspects of the present invention are directed to a working vehicle capable of simplifying the structure and reducing manufacturing costs by realizing a configuration in which the tying-down attachment point doubles as the lifting attachment point.

In view of the above, the following embodiments are described below.

A working vehicle according to the present invention includes tying-down attachment points for locking a tightening member for preventing reversal at the time of transportation or parking in at least the front of a vehicle body, in which the tying-down attachment points are arranged at right-and-left two places on a front end surface of the vehicle body, capable of locking a lifting member for lifting the vehicle body upward and having strength in a vertical direction enough to withstand a load applied at the time of lifting the vehicle body upward after locking the lifting member, thereby doubling as lifting attachment points.

Advantageous Effects of Invention

According to the present invention, the configuration in which the tying-down attachment point doubles as the lifting attachment point can be realized. Accordingly, the structure can be simplified and manufacturing costs can be reduced by reducing the number of components and man-hour.

DESCRIPTION OF EMBODIMENTS

Figure 1:
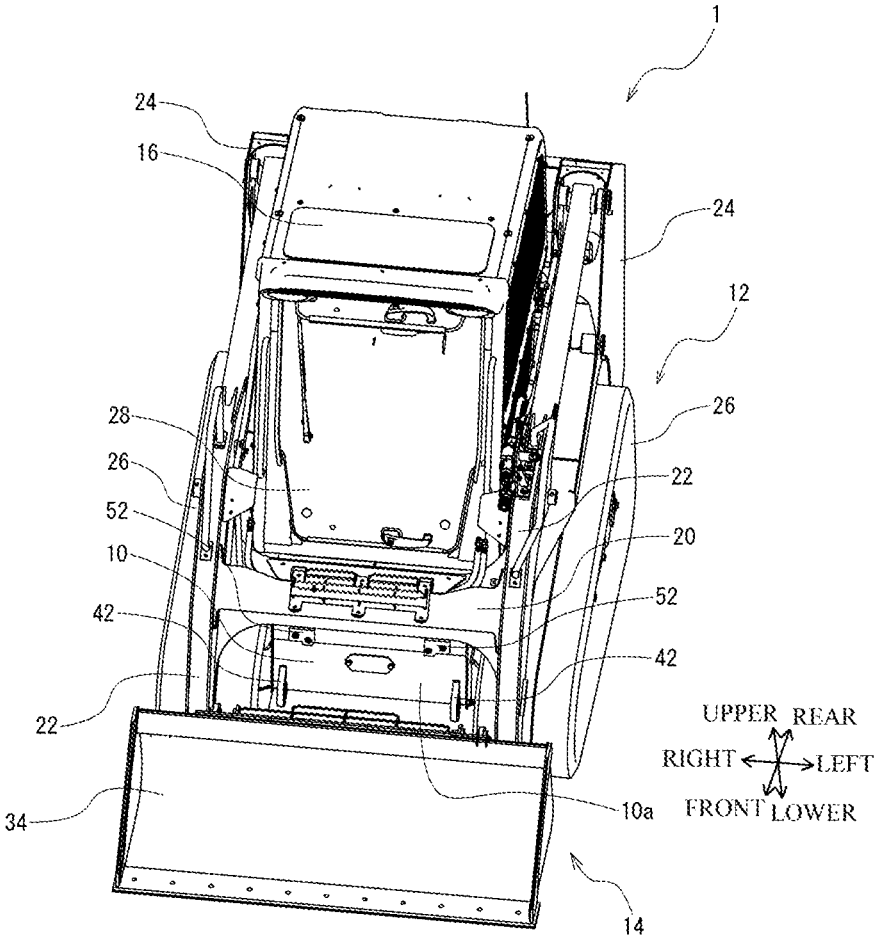
FIG. 1 is a perspective view on a front side showing an example of a working vehicle according to an embodiment of the present invention.
Figure 2:
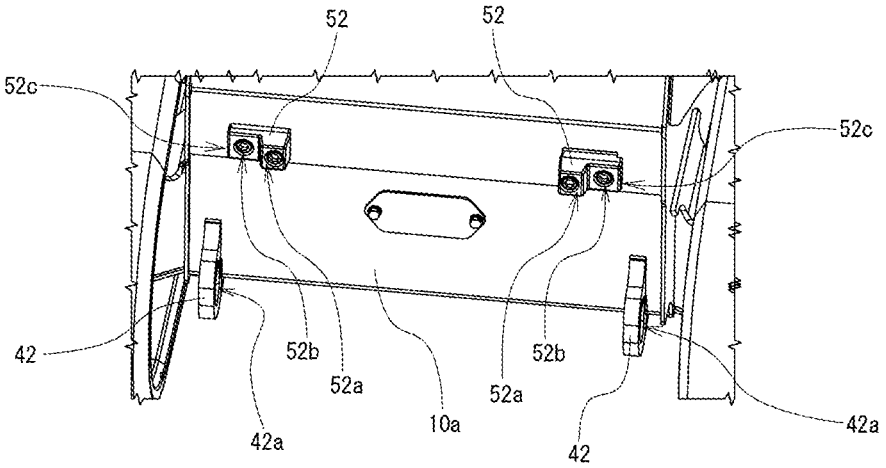
FIG. 2 is an enlarged view of a portion of a front end surface of the working vehicle in FIG. 1.

Hereinafter, an embodiment of the present invention will be explained in detail with reference to the drawings. FIG. 1 is a perspective view (schematic view) showing an example of a working vehicle 1 according to the embodiment, which is seen from the front. FIG. 2 is an enlarged view of a portion of a front end surface 10*a* of the working vehicle 1 shown in FIG. 1. In the drawings, directions of upper and lower, right and left, and front and rear of the working vehicle 1 may be shown by arrows for convenience of explanation. In all drawings for explaining the embodiment, the same symbols are given to members having the same functions and repeated explanation thereof may be omitted.

The entire structure of the working vehicle 1 will be explained. Although a crawler-type skid steer loader traveling with crawlers will be explained as an example here, the present invention is not limited to this.

The working vehicle 1 is configured by including travel units 12 at right and left of a vehicle body 10, a work unit (loader unit in the embodiment) 14 in the front of the vehicle body 10, an operator cabin 16 at the center of the vehicle body 10, an engine room 18 housing an engine (not shown) and so on in the rear of the vehicle body 10 and arm posts 24 to which arms 22 for operating the work unit 14 at right and left in the rear of the vehicle body 10 are attached as shown in FIG. 1. The travel units 12 have right and left pair of crawlers (endless crawler belts) 26 as an example. However, the travel units are not limited thereto, and the travel units 12 may have right and left pair of tires to travel (referred to as a "skid steer loader") (not shown).

First, the work unit 14 is configured by including the arms 22 arranged at the right and left of the operator cabin 16, the arm posts 24 at right and left in the rear of the vehicle body 10, right and left pair of arm cylinders (not shown) attached to be extended over the arms 22 and an attachment (a bucket as an example) 34 attached to front ends of the arms 22 through brackets 32. Here, a plurality of pivot points for attaching the arms 22 and the right and left arm cylinders are provided in the right and left arm posts 24. According to the structure, the arms 22 are operated to swing vertically with respect to the vehicle body 10 by operating the arm cylinders to be stretched and contracted. In order to improve the strength, to stabilize movements of the work unit 14 and for other purposes, an arm cross member 20 connecting the right and left pair of arms 22 to each other is provided at a front position of the operator cabin 16.

The brackets 32 according to the embodiment are pivotally connected to tip ends of the arms 22 so as to swing vertically, and the bucket 34 is attached to the bracket 32 so as to be detachable. A right and left pair of bucket cylinders (not shown) are attached to be extended over the brackets 32 and the arms 22. According to the structure, the brackets 32, namely, the attached bucket 34 can be operated to swing vertically with respect to the arms 22 by operating the bucket cylinders to be stretched and contracted. It is also possible to adopt a structure in which the brackets and the bucket are integrally formed (not shown).

Next, the operator cabin 16 is formed in an approximately rectangular box-shape that forms an operation room into which an operator (worker) enters, and a front door (door with a glass or plastic window portion) 28 doubling as an entrance that can be opened and closed is provided on the front side. An operator seat on which the operator sits so as to face the front side, operation levers and so on for operating actions of the travel units 12 and the work unit 14 are arranged inside the operator cabin 16 (they are not shown).

The operation of the working vehicle 1 is performed by the operator sitting on the operator seat and operating the operation levers. That is, in accordance with operations of the operation levers, the vehicle body 10 can be traveled and moved by driving the right and left travel units 12, the arms 22 can be swung vertically with respect to the vehicle body 10 by operating the right and left arm cylinders to be stretched and contracted, or the bucket 34 can be swung vertically with respect to the arms 22 by operating the right and left bucket cylinders to be stretched and contracted.

Next, the engine room 18 is provided at the rear of the vehicle body 10 (a rear position of the operator cabin 16), and an engine, the other apparatuses and so on are loaded so as to be housed thereinside. A water-cooled diesel engine is used for the engine as an example, and however, the engine is not limited thereto. The above-described travel units 12, the arm cylinders and the bucket cylinders are configured to be driven by receiving hydraulic oil fed from a hydraulic pump (not shown) driven by the engine.

Subsequently, characteristic structures of the working vehicle 1 according to the embodiment will be explained. First, tying-down attachment points 42 for locking a tightening member (not shown) for preventing reversal at the time of transportation or parking are provided in the front of the vehicle body 10. Tying-down attachment points 44 are also provided in the rear of the vehicle body 10 for the same purpose. Here, the tightening member is generally configured by including, for example, chain, wire rope, rope or a belt. A structure of including a locking tool such as a hook at a tip end thereof is widely used.

The tying-down attachment points 42 in the front of the vehicle body 10 are arranged at right and left two places in a lower part on the front end surface 10*a*. As an example, the tying-down attachment point 42 is formed by using a plate-shaped member with a given thickness (approximately 20 to 50 mm as an example) with a hole 42*a* in which the above tightening member is locked, which is provided in a state of protruding from the front end surface 10*a* of the vehicle body 10 toward the front so that a central axis of the hole 42*a* is parallel to a right and left direction of the vehicle body 10. That is, a plate surface is parallel to the front and rear direction as well as the upper and lower direction of the vehicle body 10. Note that the above term "parallel" includes both a side-by-side arrangement and an abreast arrangement. The tying-down attachment point 42 is not limited to the plate-shaped member but may be configured by using an annular member having a hole (or including a space portion corresponding to the hole) in which the tightening member is locked, a member formed by connecting a rod-shaped member to the plate-shaped member and so on.

Figure 3:
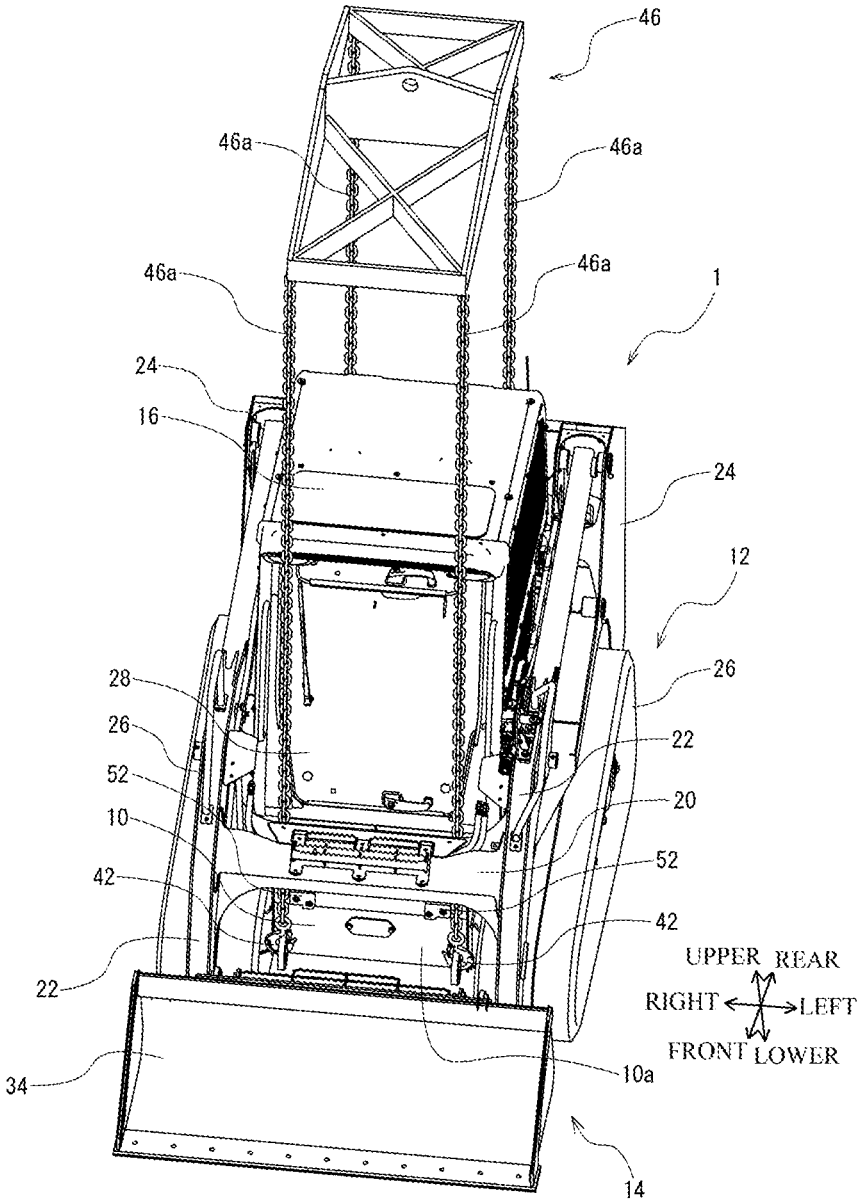
FIG. 3 is a perspective view on the front side showing a state where the working vehicle shown in FIG. 1 is lifted by using a lifting member.
Figure 4:
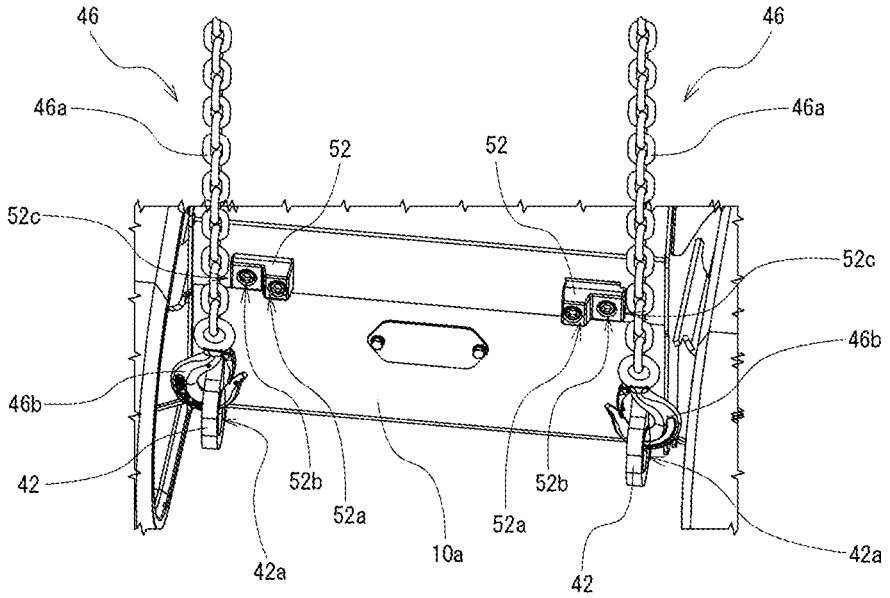
FIG. 4 is an enlarged view showing the portion of the front end surface of the working vehicle in FIG. 3.
Figure 5:
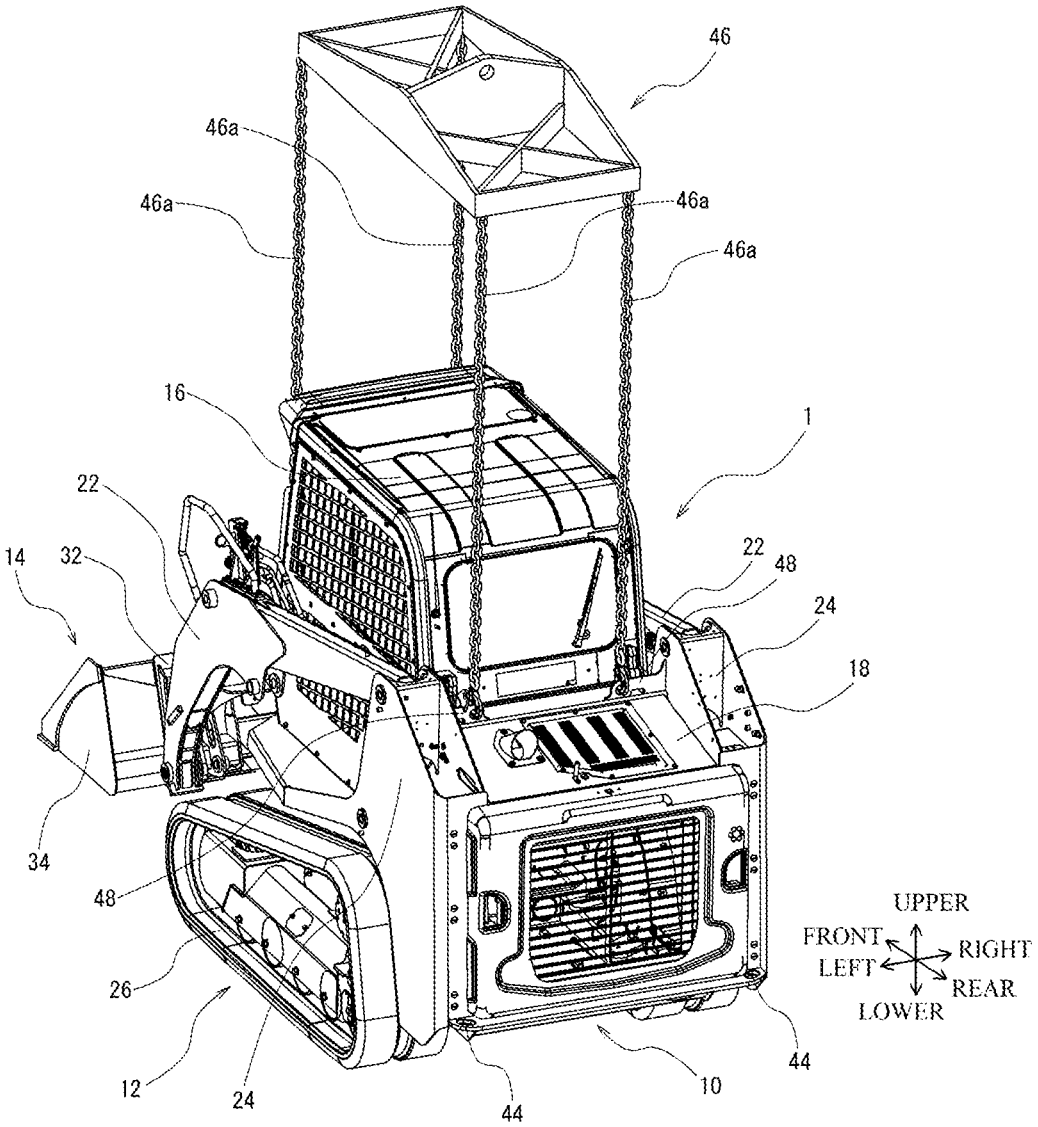
FIG. 5 is a perspective view on a rear side showing the state where the working vehicle shown in FIG. 1 is lifted by using the lifting member.
Figure 6:
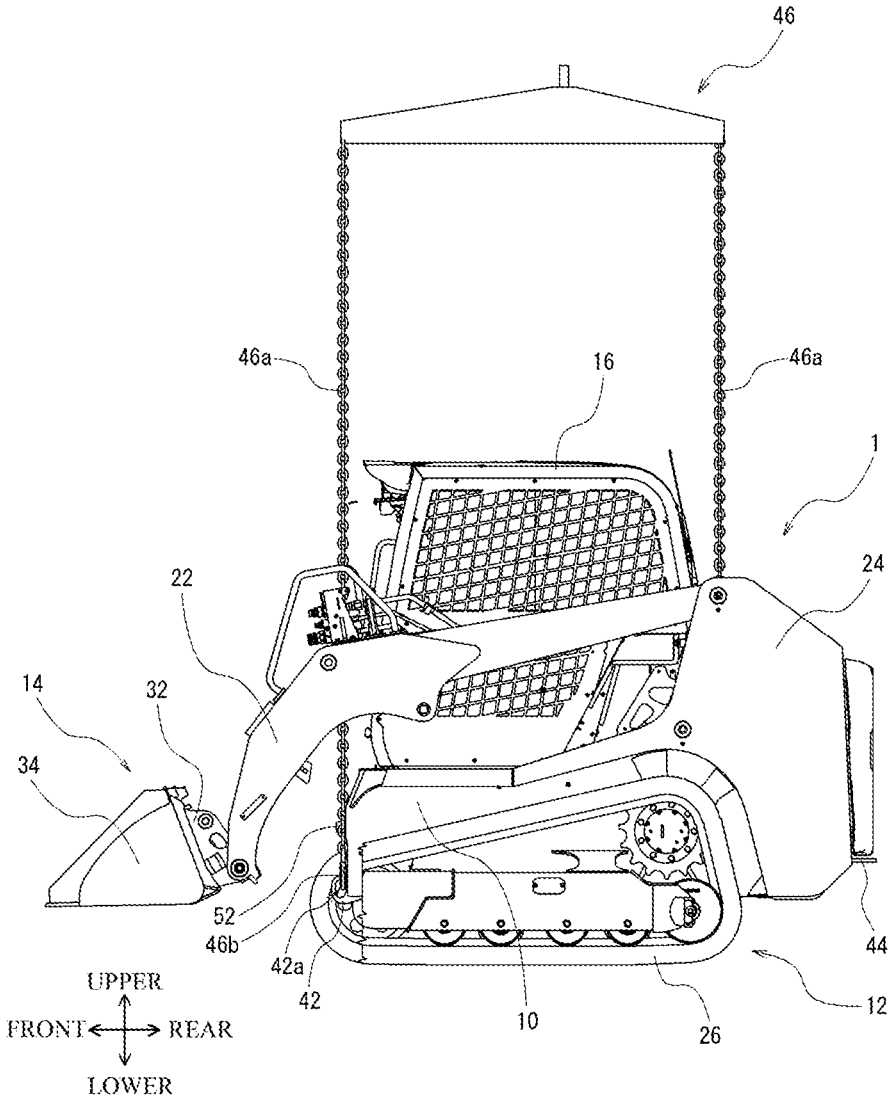
FIG. 6 is a side view showing the state where the working vehicle shown in FIG. 1 is lifted by using the lifting member.

The tying-down attachment point 42 also has a shape in which a lifting member 46 for lifting the vehicle body 10 upward can be locked, which is configured to have strength (strength of the component itself and strength of an attachment portion used when being attached to the vehicle body 10 by welding, tightening a bolt and so on) in a vertical direction (including directions within a given allowable angle range) enough to withstand a load applied at the time of lifting the vehicle body 10 upward after locking the lifting member. In the embodiment, the hole 42*a* in which the tightening member is locked will be a hole in which the lifting member 46 is locked. The lifting member 46 is configured by including lifting tools 46*a* formed of, for example, chain, wire rope, rope or belts. A structure in which a hook 46*b* is provided at a tip end as a locking tool is adopted, and however, the structure is not one limitedly adopted in the present invention and other locking tools and locking methods may be used (not shown). Here, a state in which the working vehicle 1 is lifted upward by using the lifting member 46 having four lifting tools 46*a* is shown in FIG. 3 (a perspective view seen from the front), FIG. 4 (an enlarged view of a portion of the front end surface 10*a* in FIG. 3), FIG. 5 (a perspective view from the rear) and FIG. 6 (a side view).

Accordingly, for example, when assuming a case where lifting attachment points are provided at two places each in the front and in the rear so as to lift the working vehicle 1 by the four lifting tools 46*a*, a load corresponding to ¼ of a vehicle weight of the working vehicle 1 is applied to one lifting attachment point though the loads are different to some degree according to a gravity center position.

Here, the related-art tying-down attachment points are provided only for preventing reversal at the time of transportation or parking, therefore, these tying-down attachment points only have strength enough to withstand a load, for example, applied by swinging in right-and-left and front-and-rear directions occurring at the time of being placed on the deck of the transport vehicle and transported. Accordingly, if the working vehicle 1 is lifted with the lifting member locked in the tying-down attachment points, a phenomenon that the tying-down attachment points are torn off may occur. Even when the working vehicle 1 can be lifted to some height, the above phenomenon may occur during lifting upward, which might lead to a fall accident of the working vehicle.

In response to the above, the tying-down attachment points 42 according to the embodiment having the above structure have strength in the vertical direction (including directions within a given allowable angle range) enough to withstand a load set at the time of lifting the vehicle body 10 upward, therefore, the vehicle body 10 can be lifted with the lifting member 46 locked. That is, the tying-down attachment points 42 can double as the lifting attachment points.

Accordingly, it is not necessary to provide the lifting attachment point and the tying-down attachment point separately as exclusive goods as in related art, therefore, a space and a support structure can be mainly simplified and costs can be reduced by reducing the number of components and man-hour for design and manufacture.

Concerning a structure in the rear of the vehicle body 10, tying-down attachment points 44 (two places in a lower part on the rear end surface) and lifting attachment points 48 (two places behind the operator cabin 16) are provided separately, however, the combined structure in the same manner as the tying-down attachment points 42 in the front may be adopted.

Figure 7:
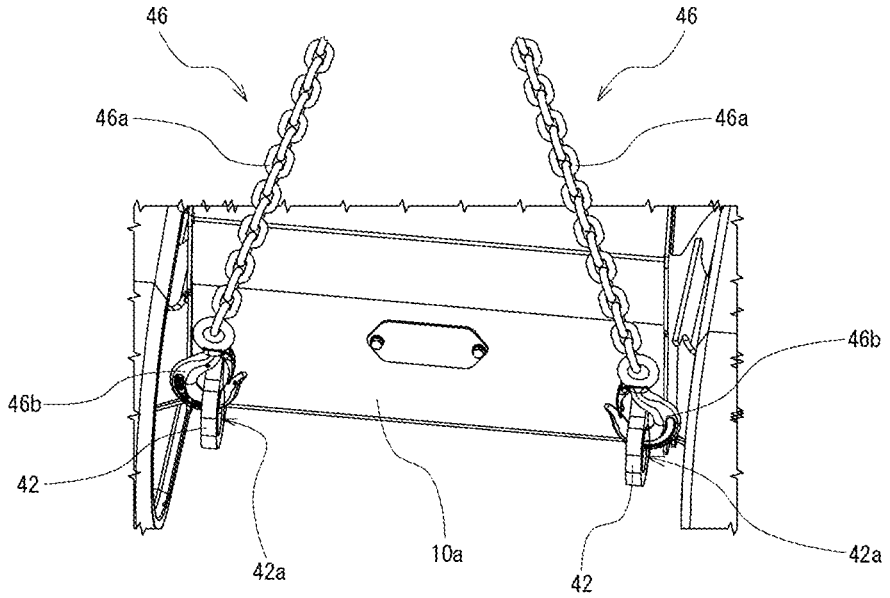
FIG. 7 is an explanatory view for explaining an example of a problem to be solved by the present invention.

Incidentally, in a case where the lifting tools 46*a* hang down within a given allowable angle range from the vertical direction with respect to the tying-down attachment points 42 when the lifting member 46 is locked in the tying-down attachment points 42 and the vehicle body 10 is lifted upward, no trouble happens as far as strengths of the lifting member 46 and the tying-down attachment points 42 are sufficient. However, there can be a case where it is difficult to prepare a lifting member most suitable for sizes of all working vehicles (particularly, dimensions in the right and left direction of vehicle bodies) in the work site. For example, when the vehicle body 10 is tried to be lifted by using a lifting member having a smaller dimension in the right and left direction than a given dimension as shown in FIG. 7, the lifting tools 46*a* locked in the tying-down attachment points 42 are largely inclined inward. At this time, the tying-down attachment points 42 have strength in the vertical direction (including directions within a given allowable angle range) enough to withstand the load applied at the time of lifting the vehicle body 10 upward. However, in the state where the lifting tools 46*a* are largely inclined, an unexpected force toward the inside in the right and left direction of the vehicle body acts on the tying-down attachment points 42 at the time of lifting the vehicle body 10 upward. There is a danger that the tying-down attachment points 42 are bent or broken due to the above force.

In response to the above problem, the vehicle body 10 according to the embodiment is provided with guide portions 52 for guiding the lifting tools 46*a* to hang down within a given allowable angle range from the vertical direction with respect to the tying-down attachment points 42 and reach the tying-down attachment points 42 at the time of locking the lifting member 46 in the tying-down attachment points 42 and lifting the vehicle body 10 upward.

More specifically, when the lifting tool 46*a* is inclined inward or outward (inward in the embodiment) in the right and left direction of the vehicle body 10 beyond the given allowable angle range from the vertical direction, the above problem can be solved by the following effect. That is, when the inclined lifting tool 46*a* is allowed to abut on the guide portion 52, it is possible to obtain an effect of guiding the lifting tool 46*a* so that the lifting tool 46*a* is corrected to the state of hanging down within the given allowable angle range from the vertical direction with respect to the tying-down attachment point 42 at a position lower than the abutting position and reaches the tying-down attachment point 42. According to the structure, when the vehicle body 10 is lifted upward by using the lifting member 46, it is possible to prevent the unexpected force toward the inside in the right and left direction of the vehicle body from being acted on the tying-down attachment point 42 and to prevent the tying-down attachment point 42 from being bent or broken. The allowable angle range is set in accordance with the strength of the tying-down attachment point 42, which is, for example, approximately 0 to 5 degrees.

The guide portions 52 according to the embodiment are provided at two places in positions above the vehicle body 10 and on an inner side in the right and left direction with respect to arrangement positions of the tying-down attachment points 42 provided at two places on the front end surface 10*a*.

The guide portions 52 are formed in a block shape protruding toward the front of the vehicle body 10. A front surface has a two-stage structure including a first front surface 52*a* positioned far from the front end surface 10*a* and a second front surface 52*b* positioned close to the front end surface 10*a*, and however, the structure is not one limitedly adopted and structures of one stage, three stages or more may be adopted.

Figure 8:
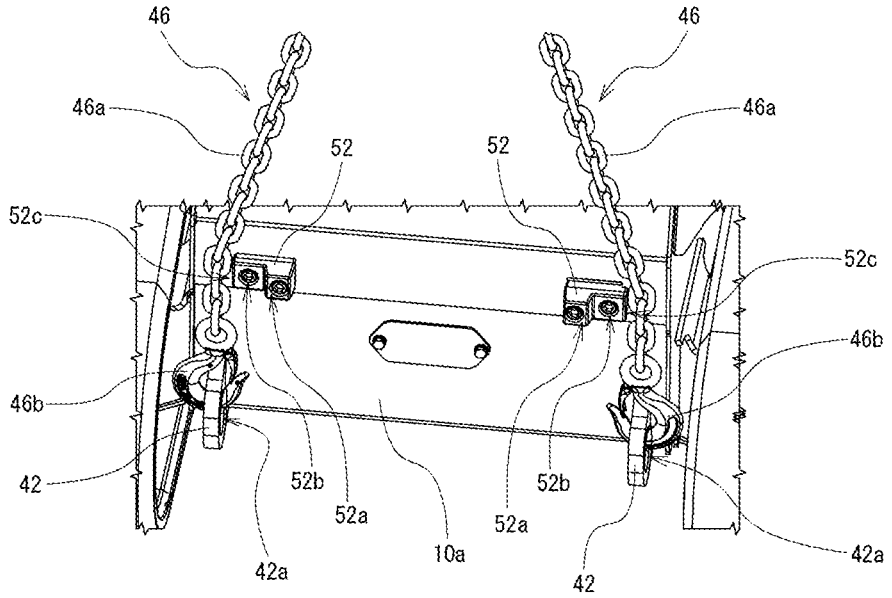
FIG. 8 is an explanatory view for explaining a means for solving the problem shown in FIG. 7.

In each of the guide portions 52 provided at two places, an outer-side surface 52*c* in the right and left direction is formed as a guide surface for the lifting tool 46*a*. That is, in a case where the lifting tool 46*a* is inclined beyond the above appropriate range at the time of locking the lifting member 46 in the tying-down attachment points 42 and lifting the vehicle body 10, the effect of correcting the inclination by allowing the lifting tool 46*a* to abut on the guide surface 52*c* and allowing the lifting tool 46*a* to hang down toward the tying-down attachment point 42 within the given allowable angle range from the vertical direction can be obtained (see FIG. 8).

Here, the guide surface 52*c* is preferably a shape having a front-and-rear dimension approximately the same as or larger than the maximum width dimension of the lifting tool 46*a*. Moreover, it is preferable to adopt a structure in which the guide portions 52 are arranged in the vehicle body 10 so that each guide surface 52*c* is arranged in a range between a position above the tying-down attachment point 42 in the vertical direction and a position shifted from the above position toward the inner side in the right and left direction of the vehicle body 10 by the maximum width dimension of the lifting tool 46*a*. According to the structure, the above effect can be obtained more effectively.

As a modification example of the guide portion, it is possible to adopt a structure in which guide portions (not shown) similar to the guide portions 52 are arranged at two places in an upper position of the vehicle body 10 and on outer sides in the right and left direction with respect to the arrangement positions of the tying-down attachment points 42 together with the guide portions 52 or instead of the guide portions 52. According to the structure, in a case where the lifting tool 46*a* is inclined to the outer side in the right and left direction of the vehicle body 10 at the time of locking the lifting member 46 in the tying-down attachment points 42 and lifting the vehicle body 10, the operation and effect similar to the above can be obtained.

The guide portion 52 according to the embodiment is arranged in the vehicle body 10 so that the front surface (the first front surface 52*a* in this case) is positioned so as to abut on the arm cross member 20 and has a supporting strength enough to withstand a load applied when the arm cross member 20 abuts thereon. According to the structure, the guide portion 52 can double as a member stopper.

As it is not necessary to provide the guide portion 52 and the member stopper separately as exclusive goods, the space and the support structure can be mainly simplified and costs can be reduced by reducing the number of components and man-hour for design and manufacture.

Other mechanisms (a drive mechanism, a control mechanism and so on) for travel and work in the working vehicle 1 are the same as the well-known working vehicle (the crawler-type skid steer loader in this case), therefore, explanation is omitted.

As described above, the configuration in which the tying-down attachment point doubles as the lifting attachment point can be realized by the working vehicle according to the present invention. Therefore, the structure can be simplified and manufacturing costs can be reduced due to reduction in the number of components and man-hour.

It is further possible to prevent bending and breakage of the tying-down attachment point which can occur in the structure in which the tying-down attachment point doubles as the lifting attachment point.

The present invention is not limited to the above-explained embodiment and various alterations may occur within a scope not departing from the present invention. Particularly, explanation has been made by citing the crawler-type skid steer loader as an example of the working vehicle, however, the present invention is not limited to this, and for example, the present invention can be applied to other working vehicles such as a power shovel in the same manner.

What is claimed is:

1. A working vehicle comprising:

tying-down attachment points for locking a tightening member for preventing reversal at the time of transportation or parking in at least the front of a vehicle body, wherein the tying-down attachment points are arranged at right-and-left two places on a front end surface of the vehicle body, capable of locking a lifting member for lifting the vehicle body upward and having strength in a vertical direction enough to withstand a load applied at the time of lifting the vehicle body upward after locking the lifting member, thereby doubling as lifting attachment points;

wherein the lifting member includes lifting tools formed of a chain, wire rope, rope or belt, further comprising:

guide portions guiding the lifting tools by allowing the lifting tools to abut on the guide portions so as to hang down within a given allowable angle range from a vertical direction with respect to the tying-down attachment points in a case where the lifting tools are inclined beyond the given allowable angle range from the vertical direction at the time of locking the lifting member in the tying-down attachment points and lifting the vehicle body upward; and wherein the guide portions have a block shape protruding toward the front of the vehicle body and arranged at two places in positions on the vehicle body and on an inner side in a right and left direction with respect to arrangement positions of the tying-down attachment points provided at two places, and respective outer-side surfaces in the right and left direction are formed as guide surfaces on which the lifting tools abut.

2. The working vehicle according to claim 1, wherein the guide portions are arranged in the vehicle body so that each guide surface is positioned in a range between a position above the tying-down attachment point in the vertical direction and a position shifted from the above position toward the inner side in the right and left direction of the vehicle body by a width dimension of the lifting tool.

3. The working vehicle according to claim 2, further comprising:

two arms to which an attachment is attached; and an arm cross member connecting the arms to each other, wherein the guide portion is arranged in the vehicle body so that a front surface is positioned so as to abut on the arm cross member and has a supporting strength enough to withstand a load applied when the arm cross member abuts thereon, which doubles as a member stopper.

4. The working vehicle according to claim 1, further comprising:

two arms to which an attachment is attached; and an arm cross member connecting the arms to each other, wherein the guide portion is arranged in the vehicle body so that a front surface is positioned so as to abut on the arm cross member and has a supporting strength enough to withstand a load applied when the arm cross member abuts thereon, which doubles as a member stopper.

* * * * *